US006729799B1

(12) United States Patent
Raike

(10) Patent No.: US 6,729,799 B1
(45) Date of Patent: May 4, 2004

(54) PNEUMATIC WAVE GENERATOR

(76) Inventor: George W. Raike, 26 Bent Tree La., Hilton Head, SC (US) 29926

( * ) Notice: Subject to any disclaimer, the term of this patent is extended or adjusted under 35 U.S.C. 154(b) by 0 days.

(21) Appl. No.: 09/966,998

(22) Filed: Sep. 28, 2001

(51) Int. Cl.[7] ..... E04H 4/00
(52) U.S. Cl. ..... 405/79; 4/491
(58) Field of Search ..... 405/79; 4/491

(56) References Cited

U.S. PATENT DOCUMENTS

| | | | | |
|---|---|---|---|---|
| 3,629,877 A | | 12/1971 | Schuster | |
| 3,789,612 A | | 2/1974 | Richard | |
| 4,467,483 A | | 8/1984 | Bastenhof | |
| 4,515,500 A | * | 5/1985 | Bastenhof | 405/79 |
| 4,522,535 A | * | 6/1985 | Bastenhof | 405/79 |
| 4,558,474 A | | 12/1985 | Bastenhof | |
| 4,730,355 A | * | 3/1988 | Kreinbihl et al. | 4/491 |
| 4,812,077 A | | 3/1989 | Raike | |
| 4,979,244 A | * | 12/1990 | Bastenhof | 4/491 |
| 6,411,505 B1 | * | 6/2002 | DiFonzo et al. | 361/683 |

FOREIGN PATENT DOCUMENTS

| | | | |
|---|---|---|---|
| DE | 101979 | | 7/1962 |
| DE | 161548 | | 5/1968 |
| DE | 1684954 | | 2/1969 |
| GB | 2149063 | * | 6/1985 |

* cited by examiner

*Primary Examiner*—Heather Shackelford
*Assistant Examiner*—Sunil Singh
(74) *Attorney, Agent, or Firm*—Jerry Semer

(57) ABSTRACT

A pneumatic/hydraulic wave generator for a swimming pool includes a plurality of caissons communicating with the deep end of the pool through a submerged passage. A pneumatic system includes a motor-driven impeller fan housed horizontally within a manifold housing and communicating with duct lines to the caissons through pneumatic valve assemblies. Each valve assembly includes a pendulum sleeve having a butterfly valve mounted therein that is actuated by swinging movement of the sleeve between an open and a closed position. Disposed within an upper air chamber portion of each caisson below an associate caisson valve assembly is a dispersion grate for evenly distributing air from the valve assembly across the upper surface of water disposed within the caisson.

18 Claims, 12 Drawing Sheets

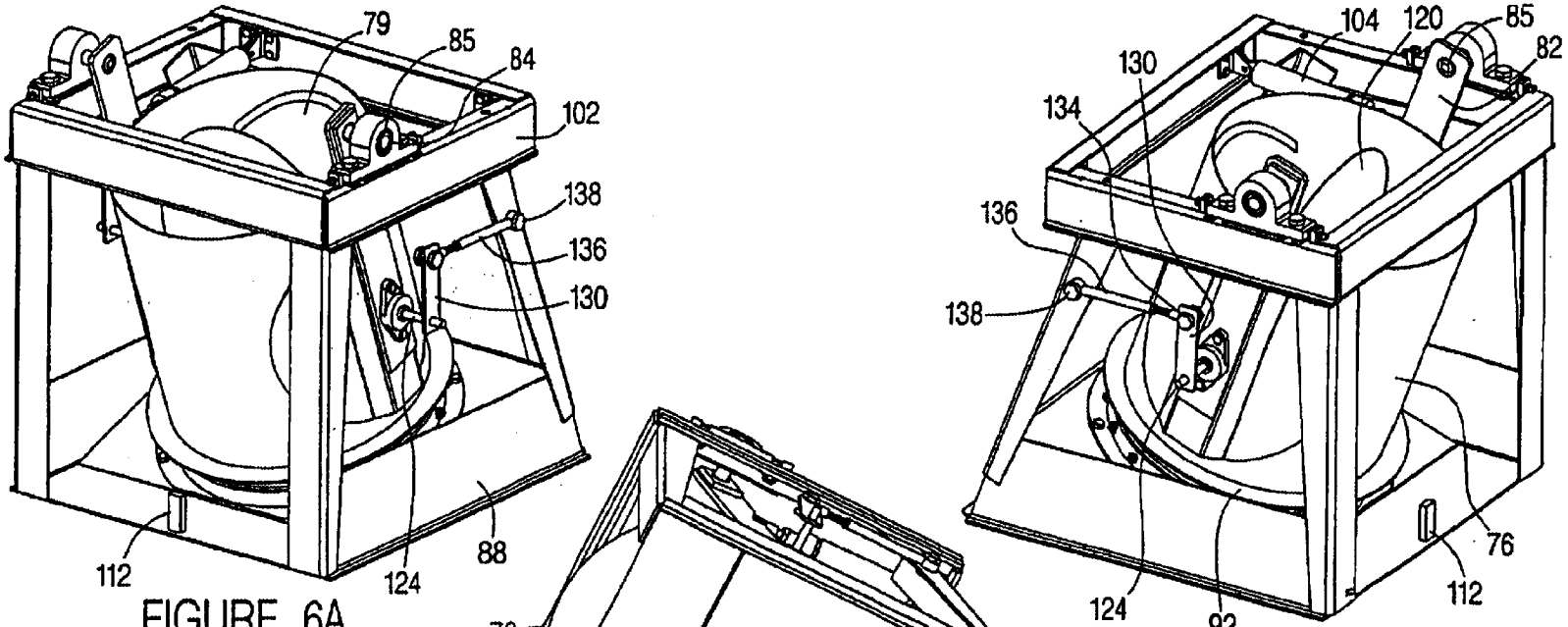
FIGURE 6A
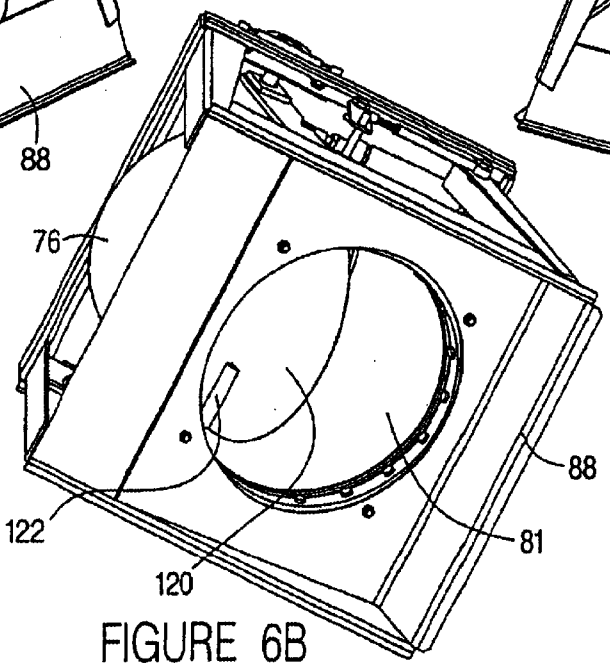
FIGURE 6B
FIGURE 6C

140

140

147
140
148
11
12
11
12

148
158
160
147
152
156
154

PNEUMATIC WAVE GENERATOR

TECHNICAL FIELD

The present invention relates generally to wave generation and, more particularly, to a pneumatic wave generation system for generating waves in a pool.

BACKGROUND ART

Wave generation systems for artificially creating waves in liquids are well known and find utilization in a range of applications. One such application is for the creation of waves in a swimming pool for recreational purposes. Swimming pools with wave-making equipment are in common use and have found widespread acceptance in numerous amusement or aquatic-theme parks throughout the world. In some applications, pools with wave making equipment serve alternatively as a venue for competitive swimming events. Aquariums provide another market for wave generation systems.

In such applications, various mechanical and pneumatic devices and apparatus have been utilized to engage and displace water at one end of a pool to create a surface wave pattern. A conventional wave generating system may house at a deep end of a pool multiple caisson chambers. A ventilator space is provided within each caisson above the surface of water therein. A source of forced air capable of effecting aspiration by applying compressed air to the space above the water surfaces in the chambers is supplied by a conduit system. When the caissons are actuated with pressurized air, the water levels therein are driven down, out a lower caisson passageway, and into the pool, thereby creating the intended wave disturbance.

The Raike U.S. Pat. No. 4,812,077 discloses a wave generator of the mentioned type. A pneumatic system includes a motor-driven fan that communicates selectively with duct lines to the caissons through a pair of two-position air directional valve assemblies. Selective actuation of the two air directional valve assemblies between caisson chambers allows the wave generator to create alternative wave shapes and patterns, augmenting the utility of the installation and its amusement value to users.

While working well, existing wave generators have certain common deficiencies and inefficiencies. First, the housings in which the caissons are deployed are relatively large and rise above the pool deck at the deep end an undesirably distance. As a result, steps must be incorporated into the pool deck in order to allow users to traverse the perimeter of the pool. In addition, the high housing of the caissons at the deep end of the pool may interfere with the placement of competitive starting blocks in the pool, and thereby defeat or inhibit the capacity of the pool to serve as a venue for competitive swimming meets. Finally, a high caisson housing is aesthetically displeasing. A wave generator providing acceptable functional utility yet having a lower vertical height compatible with providing a uniform deck area surrounding a pool is, accordingly, desired by the industry.

The size of the caisson housing in conventional wave generators, however, is a function of the relatively large air displacement required by state of the art caissons deployed therein. Since the cycle time for charging each caisson with pressurized air, discharging the generated wave from the caisson, and exhausting the caisson, is significantly short, on the order of two seconds or less, a relative large and excessive volume of pressurized air must be quickly injected into each caisson in order to correspondingly effect a quick movement of the water level downward. Currently, in state of the art wave generating systems, more air is used than optimally required because of short cycle time demands and system losses. It would, accordingly, be an advantage to reduce the amount of air required to charge a caisson in wave generating systems. Such a reduction in the volume of required air would reduce the requisite size of the caisson air chamber, allowing for a reduction in vertical height. Additionally, a reduction in the volume of air required to charge wave generating caissons would enhance system efficiencies and allow the use of smaller, more energy efficient fan systems.

In order to supply the quantity of (excessive) pressurized air into a caisson, current systems employ a high capacity fan system that distribute the air to caissons via an extensive network of large conduits or ducts. Such fans are expensive, noisy in their operation, and have a high power utilization rate, resulting in an undesirable increase in the cost of operating the wave generator. In addition, the duct network feeding air to the caissons from such large, inefficient fans include a number of relatively severe conduit bends. Such bends represent interference to the efficient flow of air to the caissons and, therefore, add to the inefficiency of the overall system. Accordingly, the industry is further in need of a wave generator that can utilize quiet, low power fan units that efficiently distribute pressurized air to the caissons through an efficient, relatively bend-free conduit system.

In conventional wave generators, the large volume of pressurized air necessary to rapidly charge a caisson is injected into the caisson by a nozzle positioned above the water level. The pressurized air, thus, is not evenly distributed over the surface of water within the caisson and its focused entry into the water tends to cause turbulence as the water level is pressured downward. Undesirable turbulence degrades the quality of the generated wave and represents a system loss of pneumatic efficiency that is likewise undesirable. Thus, the need exists for a wave generator that can equally distribute and disperse pressurized air over the surface of water within a caisson so as to result in minimal losses from turbulence and maximum pneumatic efficiency.

The Raike U.S. Pat. No. 4,812,077 discloses a pair of two-position directional valve assemblies, each capable of delivering compressed air into adjacent caissons alternatively. Each valve assembly swings to service two adjacent caisson compartments. A swinging cylinder sleeve provides fast operational speed and requires a low level of energy to actuate and brake. The valve assembly also allows the wave generator to be programmable, and the four caissons serviced by the two valve assemblies can be energized in a range of sequences. The shape and pattern of waves, as a result, may be varied and the recreational value of the wave generating system is thereby enhanced. While working well, it is desirable in certain applications to provide each caisson with its own, dedicated air injection nozzle. The nozzle should provide for efficient injection of air into its respective caisson. A valve system is further required to operatively close the nozzle during the exhaust portion of the cycle or when the actuation of the nozzle is not needed for the particular wave desired. Such a nozzle and valve arrangement should work in mutual cooperation and be economical to manufacture and maintain.

DISCLOSURE OF THE INVENTION

It is, therefore, an object of the present invention to provide a pneumatic wave generator having a novel air dispersion apparatus for equally distributing air pressure within a caisson.

It is another object to provide a pneumatic wave generator requiring a relatively low caisson housing.

It is yet another object of the invention to provide a pneumatic wave generator having an air dispersion apparatus for facilitating rapid, even dispersion of air pressure against water surface within a caisson.

Another object of the invention is to provide a pneumatic wave generator that requires a relatively low power compressed air source.

A further object of the invention is to provide a pneumatic wave generator and associative pool in which the decking surrounding the pool is uniform.

Yet a further object of the invention is to provide an improved injector nozzle for a pneumatic wave generator.

Still a further object of the invention is to provide an injector nozzle for a pneumatic wave generator having an integral shut-off valve assembly incorporated therein.

Another object of the invention is to provide an injector nozzle for a pneumatic wave generator having a rapid injection/exhaust cycle and a low power utilization rate.

A further object of the invention is to provide an injector nozzle for a pneumatic wave generator that is economical to produce and install, and economical to operate.

Another object of the invention is to provide an injector nozzle for a pneumatic wave generator having in integral shut-off valve responsive to operative movement of the injector nozzle.

The present invention has as a further object the achievement of an air distribution system for a wave generator that incorporates a relatively small, quiet, energy efficient fan and a low loss air delivery conduit network.

An additional object is to provide a wave generator having an air generation and distribution system that is economical to manufacture and operate.

These and other objects of the present invention, as well as the advantages thereof over existing wave generator assemblies, which will become apparent from the description to follow, are accomplished by the improvements hereinafter described and claimed.

In general, the present invention provides a pneumatic wave generator comprising multiple, relatively low, caissons. An associative injector nozzle assembly communicates with each caisson and delivers air to drive the water level within the caisson downward. The nozzle assembly includes a nozzle pivotally mounted to a support frame and pivotal between an open position in which air within the nozzle is free to enter the caisson and a shut-off position in which the flow of air from the nozzle is inhibited. A butterfly valve is integrally mounted within the nozzle and moves therewith between the first and second nozzle positions. The butterfly valve allows air to pass in the open position. Upon exhausting the caisson, the valve within the nozzle will move by an air cylinder or a linear actuator and close the butterfly valve. The force required to pivot and brace the nozzle is modest and the butterfly valve integrally mounted within the nozzle achieves a reliable, repeatable fit between the nozzle internal walls.

A further aspect of the invention is to provide a dispersion grate mounted across a top portion of each caisson. The grate is configured having an array of through-bores therein and vane flanges that directionally fan out to direct input air across the surface of the dispersion grate. Sidewalls of the grate through-bores are further configured to intercept the air delivered by the vane flanges and evenly direct the air downward through the grate to the water surface therebelow. The dispersion grate thus serves to efficiently distribute input air into the caisson across the surface of the water so that the water surface may be pressured downward in an efficient, rapid manner. The volume of air required to effect formation of a wave is thereby reduced, allowing for a commensurate reduction in the size of the motor providing the supply of air. The efficiency so attained allows for a reduction in the requisite height of the air chamber above the water level within each caisson. The reduction in height of the caisson in turn allows the caisson housing to assume an even, coplanar relationship with the decking surrounding the pool and eliminates the shortcomings discussed above that are endemic to state-of-the-art, multi-level wave generating pool decking.

Finally, the a further aspect of the wave generator system of the present invention is providing an air generation and distribution system including a horizontally mounted impeller fan, and an air feed conduit to each of the caissons having relatively few bends. The impeller fan efficiently draws air down into the feed conduit from above, and generated noise from the fan is generally directed upward, minimizing ambient noise levels. The system further provides an air distribution conduit network that has relatively few bends that would otherwise create an impediment to the efficient delivery of air from the fan to the caissons.

BRIEF DESCRIPTION OF THE DRAWINGS

FIG. 6A is a left rear perspective view of the valve assembly of the present invention shown in the open position.

FIG. 6B is a bottom perspective view thereof.

FIG. 6C is a right rear perspective view thereof.

PREFERRED EMBODIMENT FOR CARRYING OUT THE INVENTION

Figure 1:
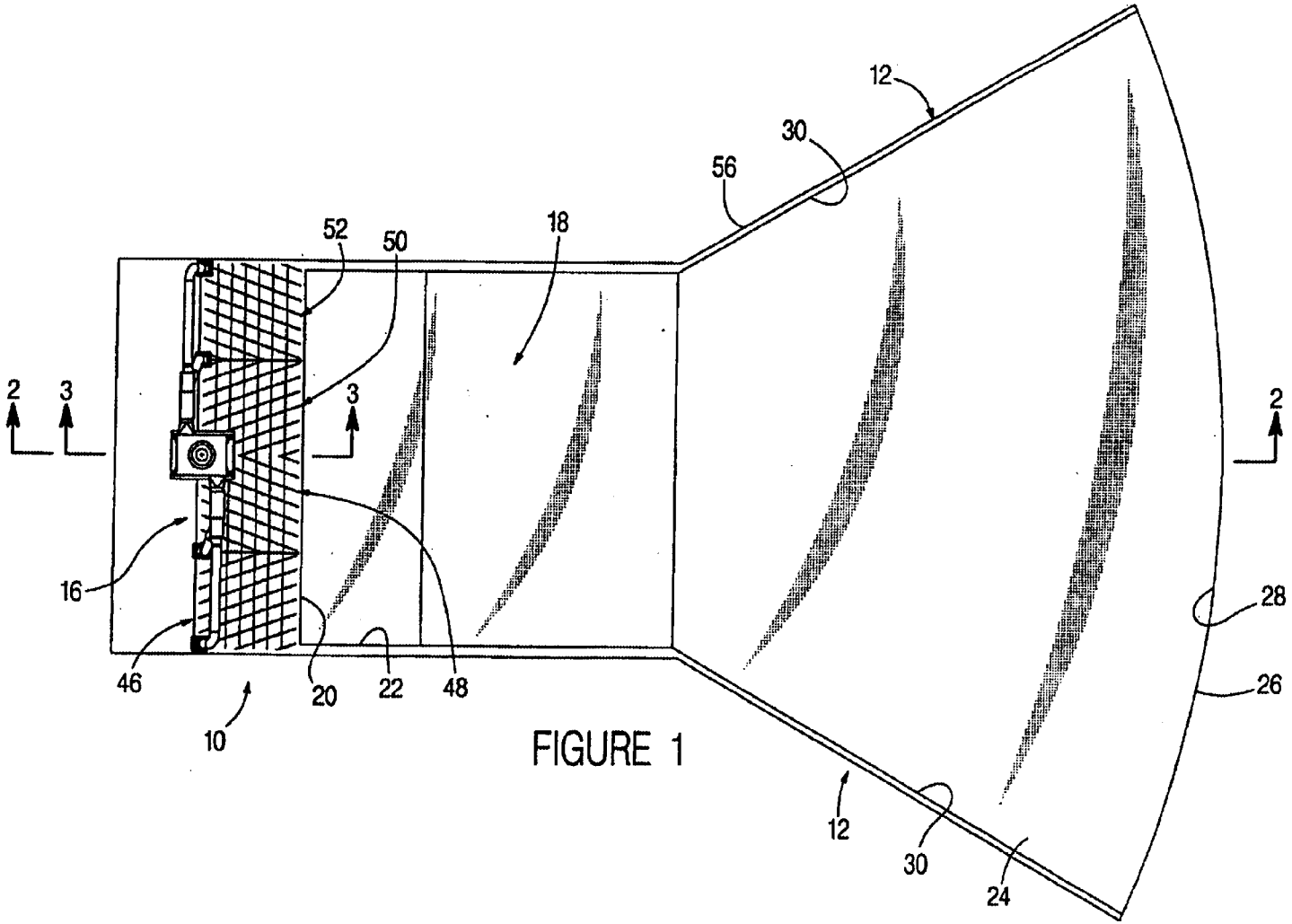
FIG. 1 is a top plan view of a pneumatic wave generator embodying the present invention with an associate swimming pool.

With initial reference to FIGS. 1, 2, and 3, as noted hereinabove, the present invention is directed to a pneumatic wave generator 10 operatively associated with a swimming pool 12 and generally comprising a hydraulic system 14 and a pneumatic system 16. The swimming pool 12 includes a deep portion 18 having a substantially square configuration with a deep end 20 and a pair of parallel, deep portion sidewalls 22. A wave generator and pool configuration of this general type is shown and described in Raike U.S. Pat. No. 4,812,077, incorporated herein by reference.

The swimming pool 12 also includes a shallow portion 24 having a shallow end 26 longitudinally opposite the deep end 20 and bounded by an arcuate shallow end wall 28. A pair of proximally converging shallow portion sidewalls 30 extend from respective deep portion sidewalls 22 to the shallow end wall 28. As shown in FIG. 2, the swimming pool 12 includes a bottom 32 with a greatest depth at the deep end 20 and a least depth at the shallow end 26. At the shallow end 26 the bottom 32 can slope upwardly to a level above a quiescent level 34 of a volume of water 36 in the pool 12 so that a gradual transition from a from a dry area of the bottom 32 into the swimming pool 12 is provided at the shallow end 28.

The hydraulic system 14 includes a caisson front wall 38 at the deep end 20 between the sidewalls 22 with a lower edge 40 spaced above the pool bottom 32 and forming a submerged passage 42 therebetween. The passage 42 extends transversely across the pool deep end 20 between the sidewalls 22. A caisson back wall 44 extends transversely between the deep end sidewalls 22 in parallel, spaced relation behind the caisson front wall 38.

In the preferred embodiment, four caissons 46, 48, 50, 52 are shown. More or fewer caissons may be employed, however, if desired without departing from the teachings of the present invention. Caissons 46, 52 represent outer caissons and 48, 50 represent inner caissons. Respective caisson partition walls (not shown) separate caissons 46, 48; caissons 50, 52; respectively, and extend between the caisson front and back walls and to the pool bottom. A caisson top slab 62 is placed over the tops of the caissons and is supported by the caisson front, back, and partition walls. The caissons 46, 48, 50, and 52 are thus substantially enclosed except at the submerged passage 42 and at an opening in the top slab that will be described hereinafter. The quiescent water level 34 in the swimming pool is between and in spaced relation from the pool bottom 32 and the top slab 62 in each caisson whereby each caisson has a lower, normally submerged portion 64 and an upper air portion 66. A system of the subject type is generally shown by Raike U.S. Pat. No. 4,812,077, incorporated herein by reference.

Figure 2:
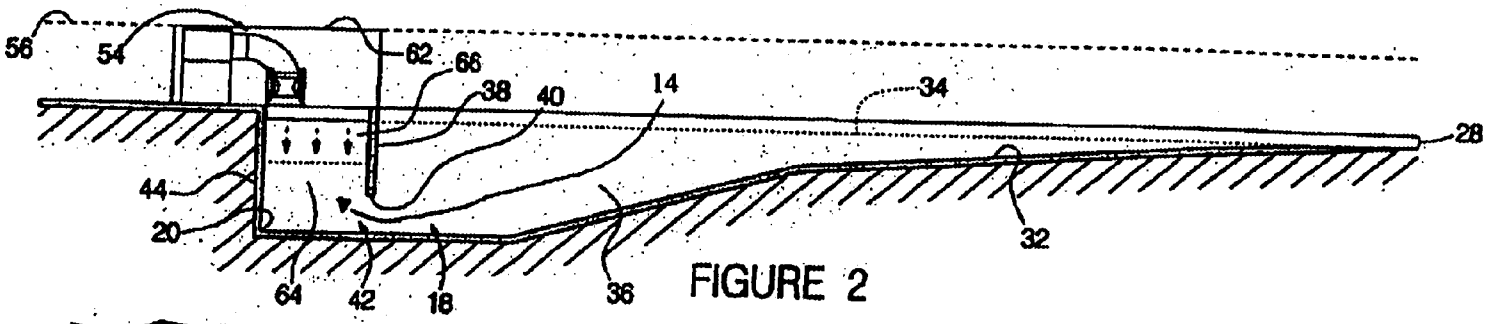
FIG. 2 is a longitudinal cross-sectional view of the wave generator taken along line 2—2 of FIG. 1.

It will be appreciated from FIGS. 1 and 2 that a generally planar deck 56 may extend about the periphery of pool 12 from the caissons 46–52 at the deep portion 18 to the shallow end 28. The level of the deck 56 at the deep portion 18 must be sufficiently high above the quiescent water level 34 to contain waves created by generator 10 within the pool 12. The amplitude of generated waves is nominally twenty-four inches. Thus, the plane of the decking 56 is generally twenty-four inches above water level 34. The caissons 46–52 in conventional state-of-the-art wave generators project above the level of deck 56 a further distance of twenty-four inches, requiring the formation of steps where the deck 56 meets the generator 10 at the deep end of the pool 12. The height of the caissons 46–52 in conventional systems is dictated by the volume of air within chamber 66 of each caisson required to force the water level within the caisson downward. Since the wave generation cycle time is short, on the order of 1.2 seconds, an overly large volume of air is used in state-of-the-art systems in order to compensate for system loss and for the uneven distribution of air pressure across the water surface within the caisson. The present invention, as will be explained below, improves the efficiency of air injection and pressure dispersion so that the caisson air portion 66 may be volumetrically reduced by a significant amount. As a result, the height of the caissons 46–52 may be reduced to twenty-four inches and the top slab 62 can thereby be made co-planar with deck 56 surrounding the pool. Consequently, the need for steps at the deep end of the pool is eliminated. A co-planar deck 56 surrounding the deep end further readily accommodates the use of competitive starting blocks in the deep end 20, allowing the pool to serve alternatively as a competitive swimming meet venue.

The advantages of a coplanar deck and caisson top surface configuration are many. First, the elimination of steps makes the pool and deck safer and easier to traverse. Secondly, the aesthetic appearance of the pool and deck is enhanced. In addition, less material is needed for construction of the caissons and by the elimination of steps, making the wave generator less expensive to manufacture and install. Finally, in applications where the pool is used secondarily as a competitive swim meet venue, an even decking surrounding the deep end of the pool allows for the use of conventional starting blocks; an advantage not afforded by existing wave generator systems.

Figure 3:
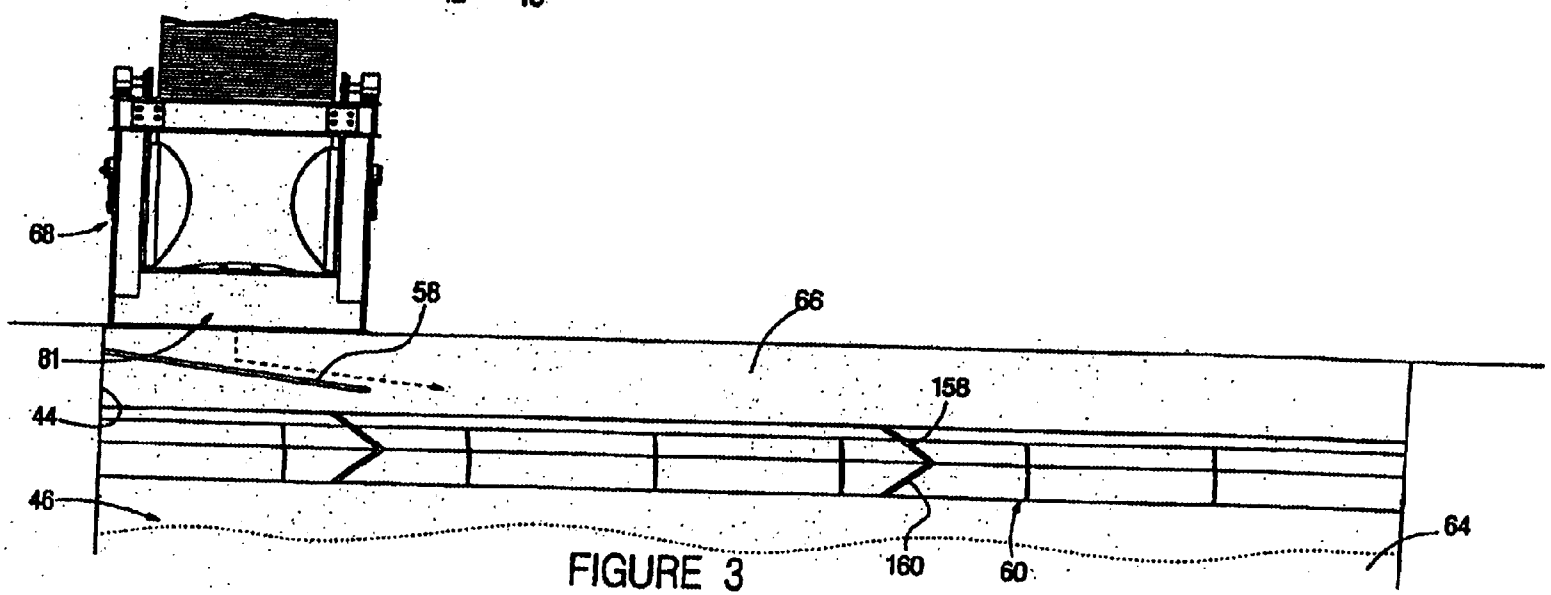
FIG. 3 is a longitudinal cross-sectional view of the wave generator taken along line 3—3 of FIG. 1.
Figures 4A, 4B, 4C:
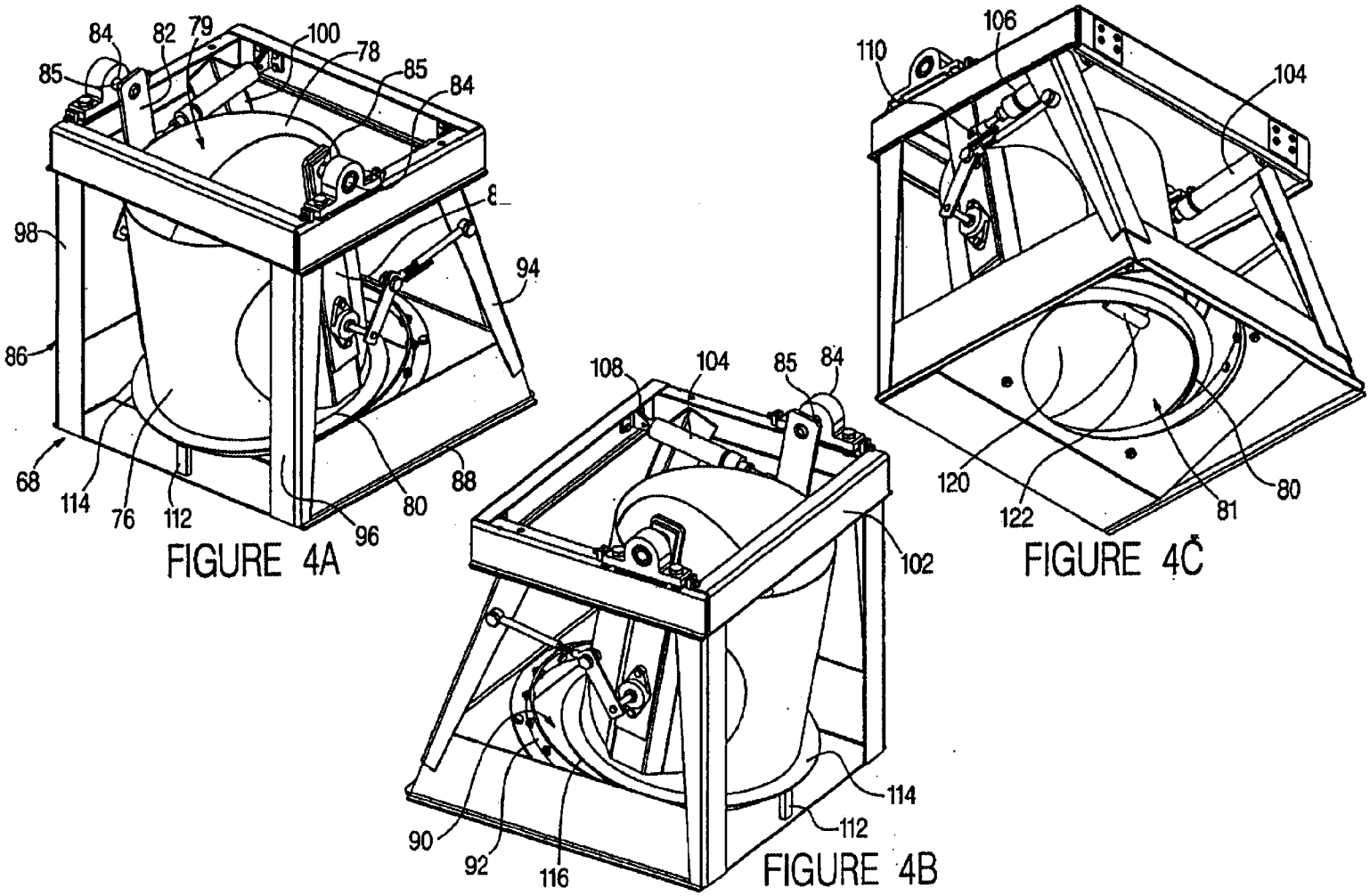
FIG. 4A is a left rear perspective view of the valve assembly of the present invention shown in the closed position.
FIG. 4B is a right rear perspective view thereof.
FIG. 4C is a bottom front perspective view thereof.
Figure 5C:
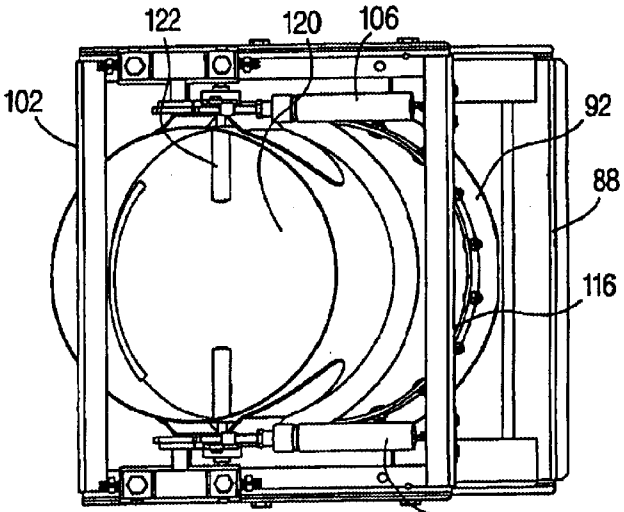
FIG. 5C is a top plan view thereof.
Figure 5B:
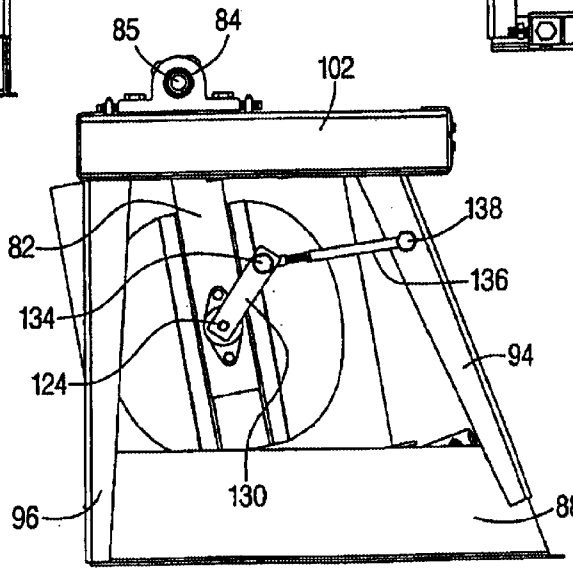
FIG. 5B is a side elevational view thereof.
Figure 5A:
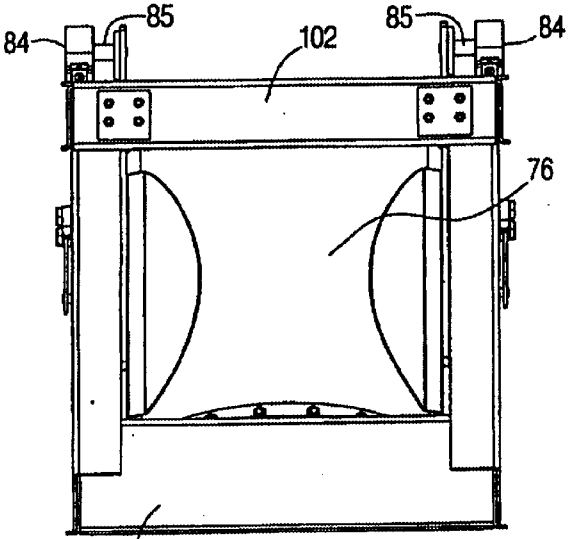
FIG. 5A is a rear elevational view thereof.
Figure 7C:
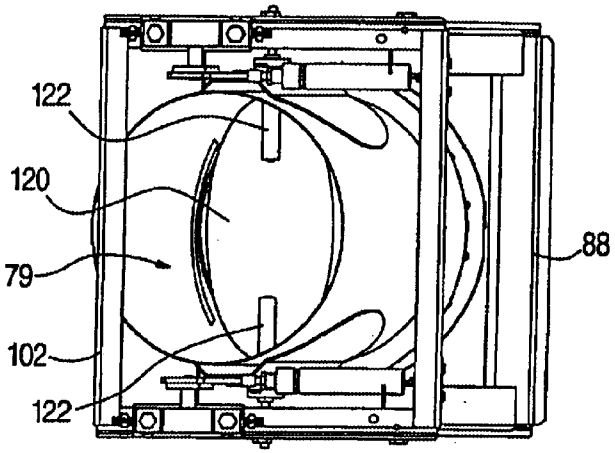
FIG. 7C is a top plan view thereof.
Figure 7B:
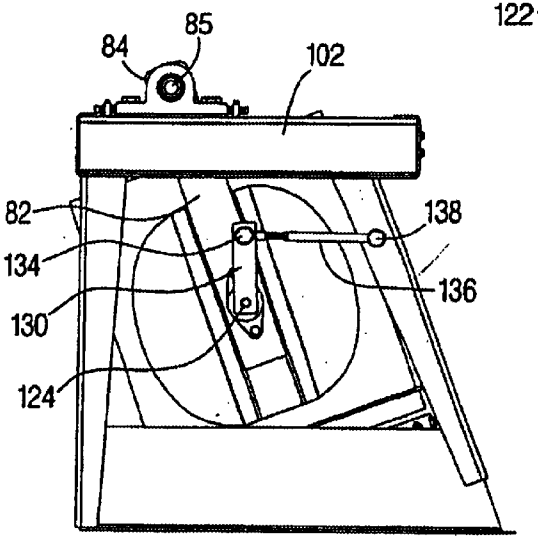
FIG. 7B is a side elevational view thereof.
Figure 7A:
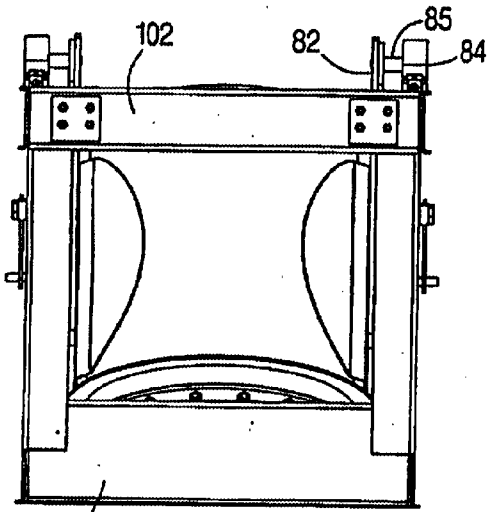
FIG. 7A is a rear elevational view thereof.

As shown in FIG. 3, each caisson 46, 48, 50, 52 is provided with a deflection plate 58 anchored to the back caisson wall 44 and depending angularly into the upper portion 66 of the caisson. A dispersion grate 60, described in detail below, is mounted across the upper portion 66 of each caisson 46, 48, 50, 52 in a generally horizontal orientation. The grate 60 may be anchored to the sidewalls of each caisson by appropriate hardware. Alternatively the grate 60 may be suspended from the top 62 of the caisson by cables or the like. Dispersion grate 60 and deflection plate 58 may be formed of any suitably hard material such as metal, plastic, or fiber glass by conventional manufacturing techniques.

Referring to FIGS. 1, 2, 3, and 15, the pneumatic system 16 includes a motor-fan assembly 162, described below, operatively mounted within a plenum, or manifold housing 180. Four pneumatic valve assemblies 68, 70, 72, and 74 are mounted to communicate with caissons 140, 142, 144, and 146, respectively. Each valve assembly 68, 70, 72, and 74, as shown in FIGS. 4A, 4B, 4C, and 17 includes a pendulum sleeve 76 having an internal axial through passage 79 extending from an upper end 78 to a lower end 80. A lower opening 81 of each sleeve 76 is in communication with and is positioned to direct air downward into a respective caisson.

The sleeve 76 is fixedly attached to a pair of elongate suspension arms 82. Each arm 82 is pivotally suspended from a support frame 86 at a pivot connection 84 by pivot pin 85. So suspended, the suspension arms and the sleeve 76 are free to swing between a substantially vertical position shown by FIGS. 4 and 5A–C, hereinafter designated as the "closed" position, and a position angularly displaced from vertical as shown in FIGS. 6 and 7A–C, hereinafter designated as the "open" position. The support frame is generally trapezoidal in side profile, and includes a square base 88 having a centered, circular bottom opening 90. A collar member 92 is mounted to circumscribe the passageway 90 and provides an upturned flange 116 that seats the cylinder 76 in its angled, open position. Extending upward from the four corners of the base 88 are L-shaped support legs 94, 96, 98, 100, that support an upper, generally square, frame 102.

A pair of pneumatic piston cylinder units 104 are included in assembly 68, each unit 104 having a cylinder end 108 anchored to the upper frame 102 and a piston end 110 connected to a respective arm 82. The units 104 are pneumatically actuated in a conventional manner to pivotally move the sleeve 76 through arms 82 between the open and closed positions. A stop protrusion 112 is further provided at the frame base 88, positioned to engage an outwardly directed peripheral flange 114 of the sleeve 76 as the sleeve 76 swings into the vertical, closed position.

Referring to FIGS. 4A–C and 17, each valve assembly 68, 70, 72, and 74 includes a butterfly valve member 118 having an elliptical body 120 and diametrically opposite cylindrical sockets 122 formed therein. A pair of pivot pins 124 have inward ends seated within the sockets 122. The sleeve 76 includes at opposite sides a pair of through-bores 126 that receive outward ends of the butterfly valve pivot pins 124 there through. A linear actuator assembly 128 is secured to each side of the sleeve 76 and comprises an actuation arm 130 fixedly connected at one end 132 to a respective pivot pin 124; and an opposite end 134 pivotally coupled to a secondary arm 136. The opposite ends 138 of arms 136 are respectively anchored to support legs 94, 100. The elliptical body 120 of valve 118 is thus pivotally mounted within the axial passageway 81 of sleeve 76, generally at a midpoint between the upper and lower ends of the sleeve 76.

Movement of the valve body 120 is effected as the sleeve 76 pivots between the angled, open position shown in FIGS. 6 and 7A–C, and the vertical, closed position depicted in FIGS. 4 and 5A–C . As cylinders 104, 106 pivot sleeve 76, valve pivot pins 124 are rotated by arm linkages 130, 136 and the valve body 120 is made to rotate between an open, unobtrusive position within passageway 81 and a closed position in which the body 120 obstructs passageway 81. The peripheral edges of elliptical body 120 are brought into close proximity with the internal cylindrical sidewalls of sleeve passageway 81 in the closed position. In the closed position, as shown in FIGS. 4A–C and 5A–C, the valve body 120 is preferably at a 45 degree angle with respect to the internal sidewalls of cylindrical sleeve 76 defining passage 81. However, the relative orientation of elliptical body 120 to the sleeve sidewalls may be varied if desired without departing from the invention. In the closed position, the flange 114 of sleeve 76 abuts against stop 112 and sleeve 76 is maintained in a vertical orientation. With the valve within sleeve 76 in the closed position, air flow through the sleeve and into the caisson is inhibited.

Each valve assembly 68, 70, 72, and 74 is swung between its two extreme positions by the pneumatic piston and cylinder units 104, 106. Extending and retracting the piston and cylinder units swings the sleeve 76 between its extreme positions. Arcuate stop flange 116 projects upwardly to intercept and engage the lower end of sleeve 76 as it reaches the angled, open position.

To open the valve, the sleeve 76 is moved by cylinder units 104, 106 to the angled position shown in FIGS. 6A–C and 7A–C. The valve pivot pins 124 are rotated by arm linkages 130, 136 to rotate valve body 120 into a substantially vertical orientation, whereby opening passageway 81. As the sleeve 76 reaches the open position, the lower end of the sleeve 76 seats within the collar 92 and abuts against collar flange 118. In the open position, the passageway 81 of sleeve 76 is unobstructed and allows the flow of compressed air from the top end 78 of sleeve 76 to the bottom end 80.

The subject valve assembly affords significant advantages over systems that utilize input and exhaust valves separate from the air supply sleeve. First, in positioning the butterfly valve 118 within the pendulum sleeve 76, and linking operation of the valve to movement of the sleeve 76, the valve and the sleeve operate synchronously in a highly reliable, cooperative manner. Secondly, in conventional systems that employ vent/relief valves separate from the air injection assembly, opening and closing the valves requires a significant additional force. In the present invention, the force required to close and open the valve 118 is derived from the force supplied to swing the sleeve 76 between the open and closed positions. In addition, the subject valve system is relatively simple compared with conventional injection configurations that deploy independent vent/relief valves. The simplification thus achieved reduces cost of the system and minimizes operational maintenance costs of the system.

Figure 15:
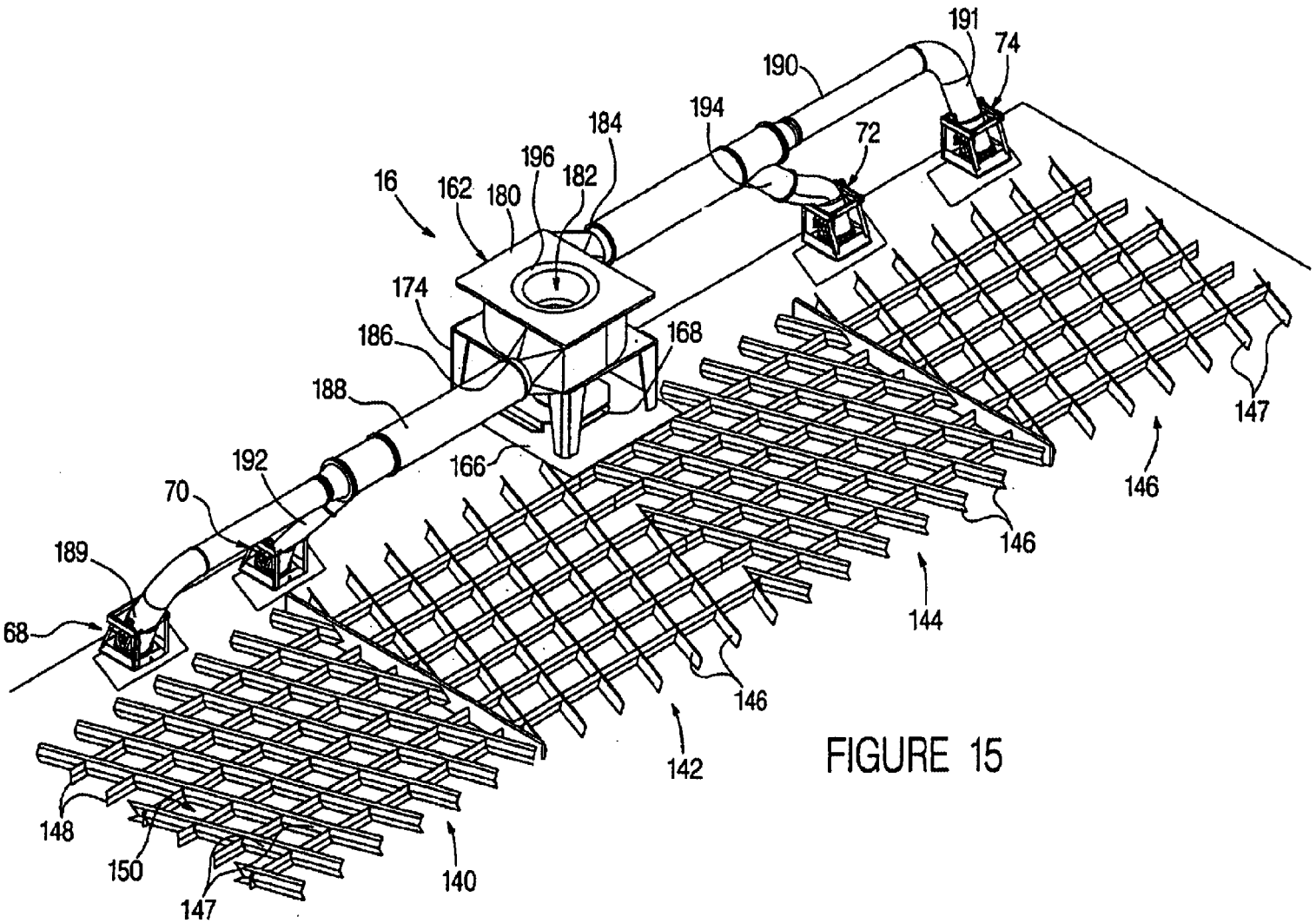
FIG. 15 is a fragmentary, top perspective view of the pneumatic system of the subject wave generator.

The dispersion grate system of the subject wave generator 10 is generally shown in FIGS. 1 and 15. Each caisson 46, 48, 50, and 52 is covered by a respective dispersion grate 140, 142, 144, and 146, respectively. The grates 140–146 are of unitary construction. Each grate 140–146 is positioned over the upper portion 66 of its respective caisson, secured by attachment to the caisson sidewalls or by suspension from the top slab of the caisson. The grates 140–146 each comprise a series of spaced apart longitudinal ribs 147 crossed by spaced apart transverse ribs 148. Formed at the intersection of longitudinal and transverse ribs 147, 148 are through passages 150. It will be noted from FIGS. 1 and 15 that the longitudinal ribs 147 of each grate 140–146 are directional, extending from a position below the valve assembly of each caisson across the caisson upper portion 66. Each grate thus directionally routes air flow from its respective valve assembly 68, 74 across the upper portion of the caisson. In the preferred embodiment, the outer valve assemblies 68, 74 are positioned at a corner of their respective caissons. In order to direct the air flow from the outer valve assemblies across the upper portion of their respective caissons, the longitudinal ribs 147 of each grate 140, 146 proceeds at a diagonal from one comer of the caisson to the opposite comer.

Figure 8B:
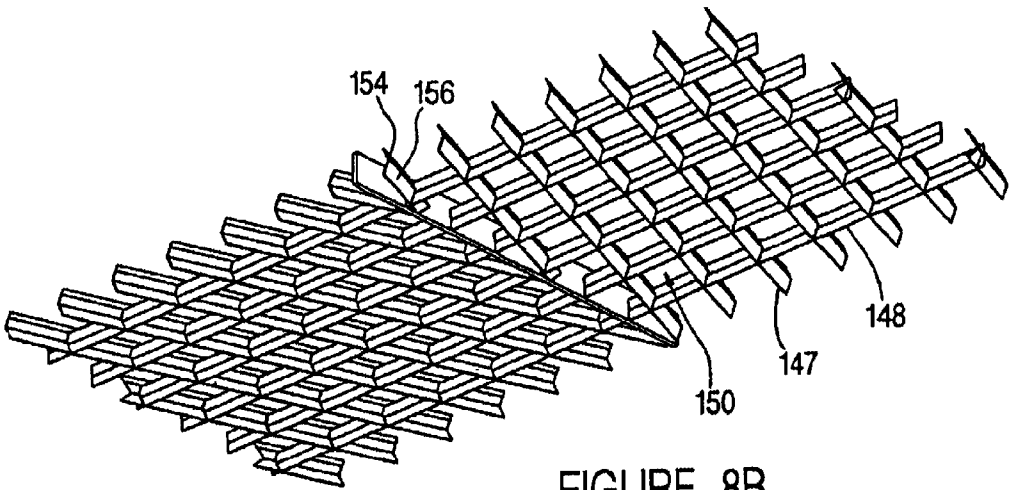
FIG. 8B is a bottom front perspective view thereof.
Figure 8A:
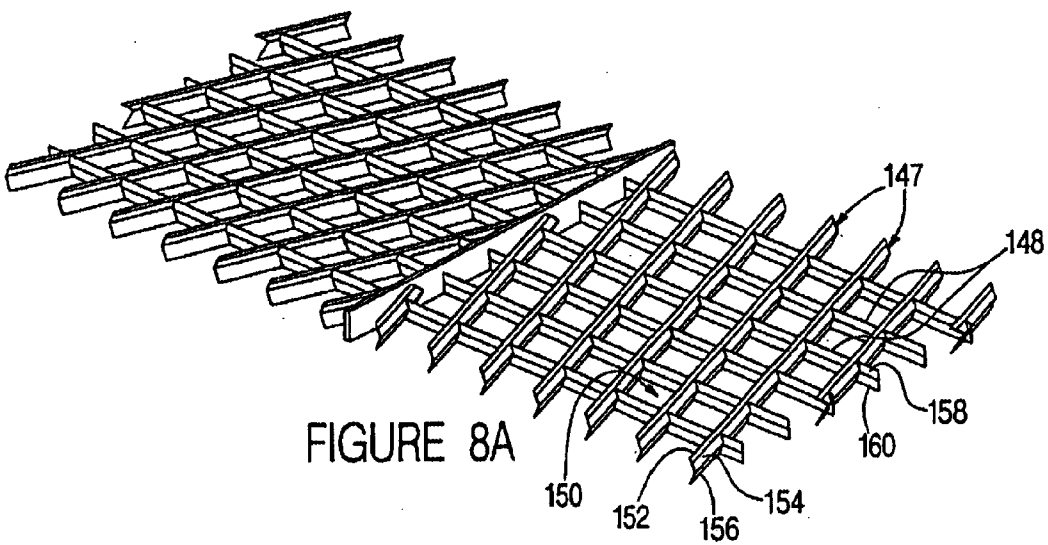
FIG. 8A is a top front perspective view of the dispersion grate of the present invention.
Figures 9, 10, 11, 12, 13:
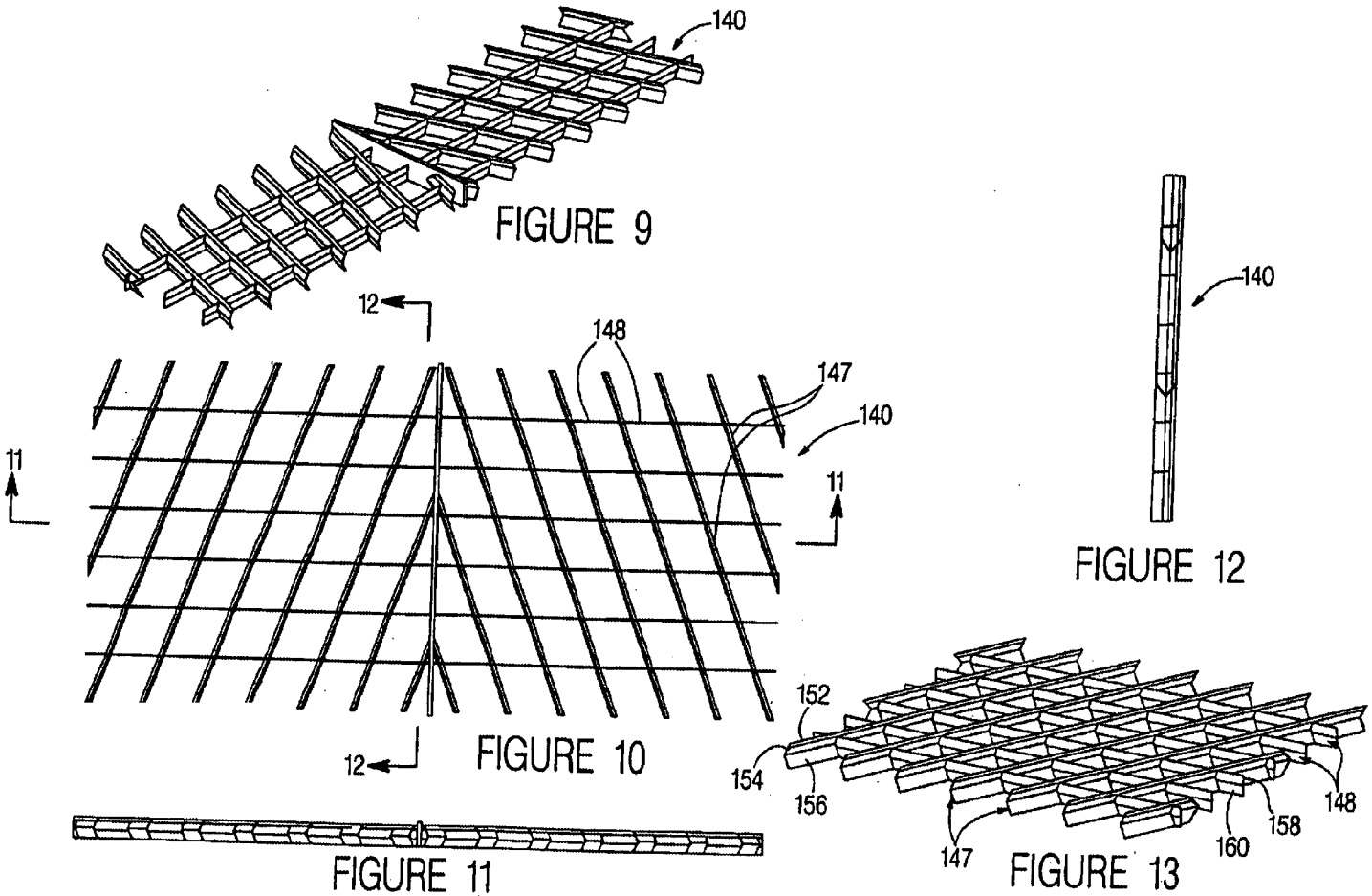
FIG. 9 is an enlarged, fragmentary, top plan view of the subject dispersion grate.
FIG. 10 is a top plan view thereof.
FIG. 11 is a transverse cross-sectional view thereof taken along the line 11—11 of FIG. 10.
FIG. 12 is a longitudinal cross-sectional view thereof taken along the line 12—12 of FIG. 10.
FIG. 13 is an enlarged, fragmentary, top perspective view thereof.
Figure 14:
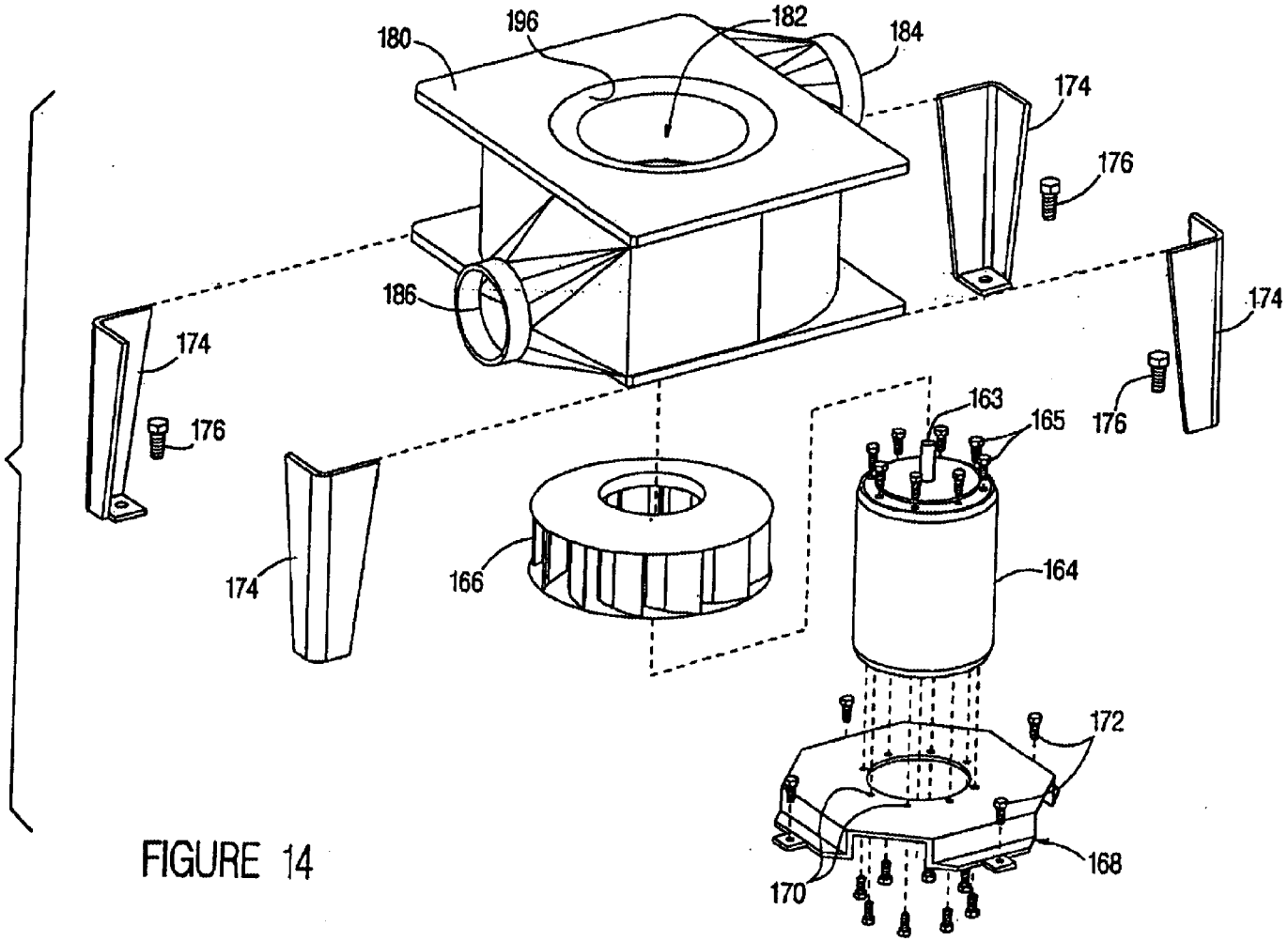
FIG. 14 is an exploded perspective view of the air impeller fan of the present invention.

The valve assemblies 70, 72 for the center caissons 48, 50, are centered above each caisson. Thus, the longitudinal ribs 147 of the center grates 142, 144 proceed straight across the top of the caisson. The specific configuration of each dispersion grate is shown in FIGS. 8A, B and FIGS. 9–13. The rib configuration of each grate is designed responsive to the location of the air injection valve assembly above the caisson. As a result, the grate provides for efficient distribution of air from the valve assembly over the entire expanse of the caisson upper portion 66. The longitudinal ribs 147 are formed to include upwardly projecting vane flanges 152 for longitudinally routing air passing over the grate. The ribs 147 further provide upper and lower wall segments 154, 156 that converge and intersect approximately at the middle of the grate. The convergent segments 154, 156 function to intercept air flow passing over the grate and direct the air downward through passageways 150 to an underside of the grate. Similarly, the transverse ribs 146 have convergent upper and lower segments 158, 160 that likewise intercept and direct air passing over the grate down through passageways 150.

From the foregoing, it will be appreciated that the vane flanges 152 of the longitudinal ribs 147 in the grates direct air from the valve assembly positioned above the grate out and over the caisson upper portion 66. The convergent configuration of the sides of the ribs 147, 148 intercept the air flow and efficiently spread the air below the grate and over the upper surface of the water within the caisson. The efficient dispersion of air across the upper portion 66 of each caisson, effected by operation of the grates 140–146, thus provides a consistent and even air distribution over the water within the caisson. Turbulence in the water surface is thereby minimized, reducing hydraulic energy loss and thus optimizing the quality of the generated wave. In addition, since the dispersion grates optimally and uniformly distribute air over the surface of the water within the caissons, less pressurized air is required to pressure the caisson water level downward. Smaller, quieter, more energy efficient fans may be utilized in the system, reducing manufacturing and operational costs.

Because air is utilized in a more efficient manner, the caisson air compartment 66 may be reduced in height. A reduction in caisson height allows the decking surrounding the pool to be made level, avoiding the cost and inconvenience of incorporating steps into the deck. Smaller caissons also provide a more pleasing aesthetic appearance, require less material in their construction, and are less likely to interfere with the placement of competitive starting blocks in the pool.

The pneumatic distribution system is shown in FIGS. 1, 14, 15, and 16. A fan assembly 162 is provided comprising a motor 164, having drive shaft 163 driveably connected to an impeller fan 166 of a type commercially available. Fan/motor combinations are in use in current wave generator systems. In such conventional systems, the fan is vertically mounted vertically and draws air sideway into a plenum. While functionally adequate, a vertically mounted fan results in a housing that is higher than optimal, making the unit visually unpleasing. Moreover, a vertically mounted fan has a vertical intake portal. Noise is readily transmitted through the vertical intake portal to the surrounding area, making the wave generator louder than desired and an annoyance to users of the pool. In contrast, the subject invention contemplates a horizontal intake portal in the top of the housing. The fan 166 is mounted horizontally within the housing and draws intake air downward. Noise reduction and a lower vertical height to the fan-motor housing is thereby achieved. Suitable mounting screws 165 are utilized. A support plate 168 attaches to the top slab of the caissons by plurality of assembly screws 172 affixed through aligned apertures 170 of the support plate 168.

Figure 16:
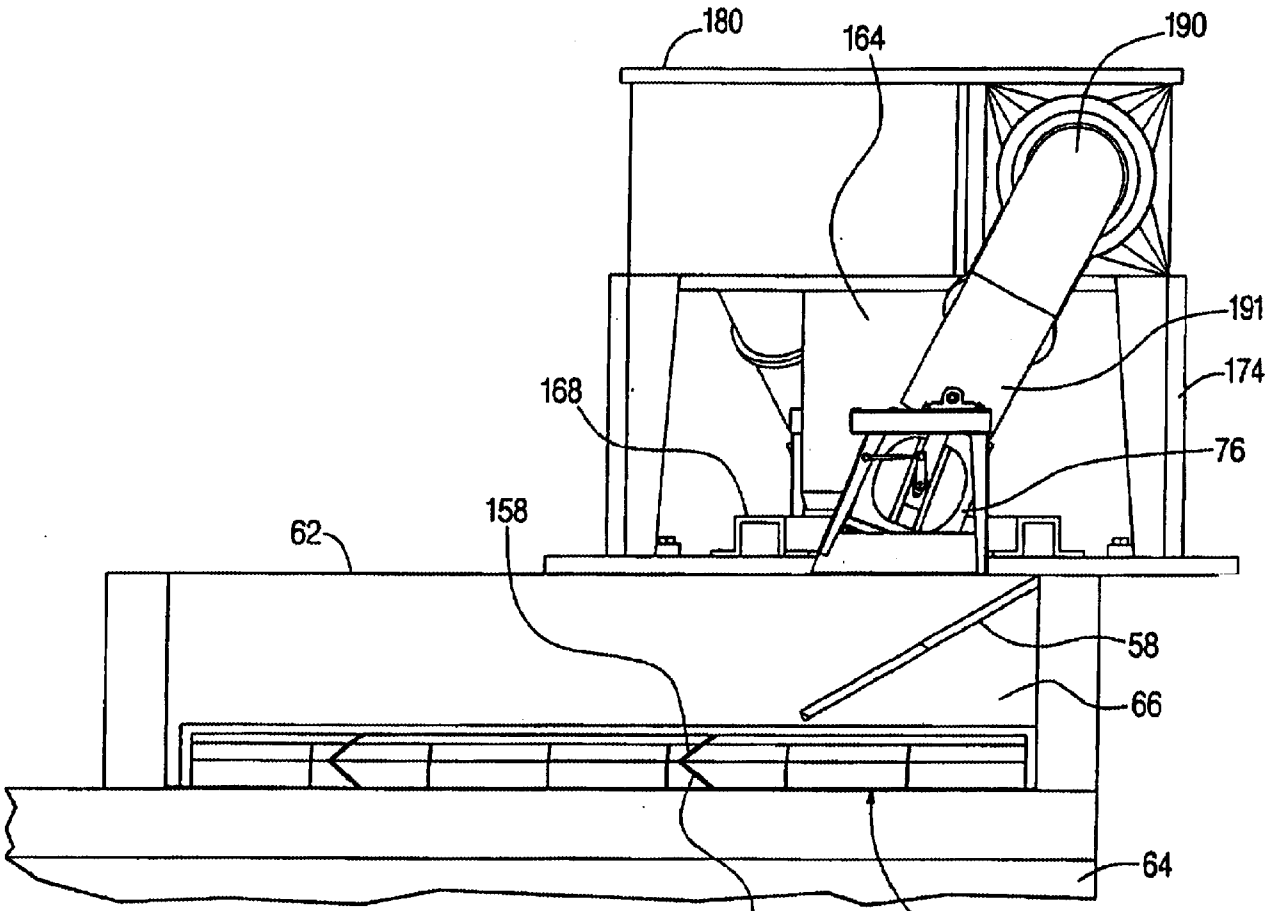
FIG. 16 is a side elevational view of the pneumatic system of the subject wave generator.
Figure 17:
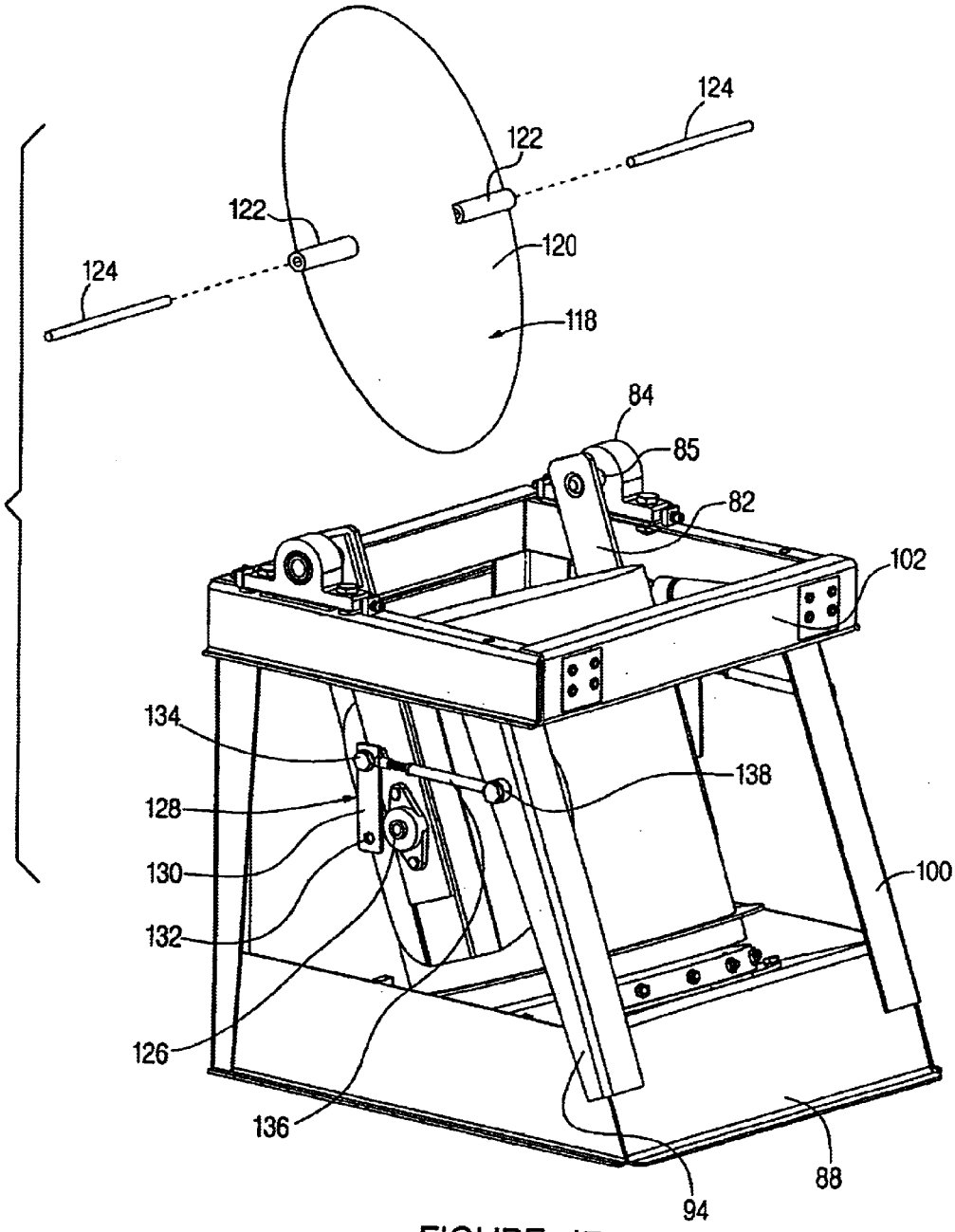
FIG. 17 is a partial exploded perspective view of the subject valve assembly of the present invention.

Four L-shaped support legs 174 mount at the comers of support plate 168 as attachment screws 176 project through leg apertures 178. A manifold housing 180 mounts to the top of the four support legs 174 and includes an upwardly opening internal chamber 182 and laterally opposite outlet ports 184, 186. The motor- fan unit 164 is received within the manifold housing chamber 182. Connected to outlet ports 184, 186 and extending outward in opposing directions from manifold housing 180 are air conduits 188, 190. Conduit 188 is provides a relatively straight, bend-free air supply line to caissons 46, 48 and conduit 190 provides a relatively straight, bend-free air supply line to caissons 50, 52. A remote end 189 of conduit 188 is attached to the pneumatice valve assembly 68 and a flexible branch duct 192 extends from conduit 188 to supply air to the valve assembly 70. On the opposite side of the motor-fan assembly 162, a remote end 191 of conduit 190 is attached to the valve assembly 74 and flexible branch duct 194 extends from conduit 190 to supply air to valve assembly 72. The conduit and duct air distribution system illustrated in FIGS. 1, 15, and 16 is relatively free from bends as compared with conventional systems. Bends or other discontinuities in the air distribution system that would impede the efficient delivery of pressurized air to the valve assemblies are, thus, avoided. In addition, the central location of the motor-fan assembly reduces the length of the conduits 188, 190, further reducing pneumatic losses. The present system, therefore, minimizes pneumatic losses in the delivery of air and thereby permits the use of a smaller, quieter, and more energy efficient motor-fan unit.

The impeller motor-fan assembly 162 is mounted horizontally within manifold housing 180 and draws air downward through the upward opening 196 into the internal chamber 182. The housing 180 supports and partially encloses the motor-fan assembly 162. The opening 196 is directed upward, as explained previously. Accordingly, noise generated by operation of the motor-fan assembly 162 is generally directed upward. The ambient noise level caused by the subject motor-fan assembly 162 is, as a result, relatively low when compared to conventional wave generators. As discussed previously, because of the enhanced efficiencies in the pneumatic and hydraulic systems of the subject wave generator, a smaller, lower capacity, motor-fan unit may be employed. A smaller motor-fan unit results in significant advantages such as a reduction in noise level, lower operational energy costs, and a lower cost of manufacture.

In operation, with initial reference to FIG. 15, the motor-fan assembly 162 draws air into the chamber 182 and forces the pressurized air down conduits 188, 190 to valve assemblies 68, 70, 72, and 74. As discussed previously, the horizontal disposition of the relatively small motor-fan assembly 162, and upward opening intake opening 196, keep ambient noise to a minimum. The valve assemblies 68, 70, 72, and 74 share a common plenum source of forced air. Moreover, the straight feed from the motor-fan assembly 162 down conduits 188, 190 minimizes pneumatic resistance and thus increases system efficiency. A smaller motor-fan unit, generating a relatively smaller volume of forced air, is therefore required.

The conduits 188, 190 deliver forced air via the conduit ends 189, 191 and ducts 192, 194, that are coupled to upper ends 78 of respective valve assemblies 68–74. As will be appreciated from FIGS. 1, 15 and 16, each pneumatic valve assembly 68–74 is mounted over access holes through the top slab 62 in communication with respective caissons 46, 48, 50, and 52. The pneumatic valve assemblies 68–74 are switched to the open position illustrated by FIGS. 6 and 7A–C by the power piston-and-cylinder units 104, 106 to selectively actuate one or more of the caissons 46–52. Movement of the sleeve 76 of the assemblies 68–74 opens through linear actuator 128 the butterfly valve assembly 118 mounted therein. Since the opening and closing of the butterfly valve assembly 118 is synchronous with movement of sleeve 76 between open and closed positions, operation of the valve assembly is automatic and reliable.

In the open position, air flows down through the sleeve 76 of the valve assembly(s) 68–74, passes the open butterfly valve assembly 118, and exits from the bottom of the sleeve 76 into the upper portion 66 of the caisson. As illustrated by FIGS. 3 and 16, air passing through the lower end 81 of each valve assembly and into the upper portion 66 of its respective caisson first encounters the deflection plate 58 and is directed inward and across an upper surface of the dispersion plate 60. The longitudinal vane flanges 152 of longitudinal ribs 147 of the dispersion plate 60 project upward above upper edges of the transverse ribs 148 of the plate 60. Vane flanges 152 act operationally to direct and spread the flow of air from the deflection plate 58 across the top of dispersion plate 60. The directional array of the dispersion plate vane flanges 152 are designed to fan from the location of the valve assembly above the caisson to cover the entire top of the caisson. Depending on the location of the valve assembly in a particular caisson, the longitudinal vane flanges may extend diagonally or straight across the caisson.

The V-shaped sides of longitudinal ribs 147 and transverse ribs 148 intercept the flow of air across the dispersion plate and direct the air downward through passageways 150 to the upper water surface within the caisson. As a result, the water levels in their respective lower, submerged portions 64 are lowered, for example about sixteen inches. The displaced volume of water emerges in front of the caisson front wall 38 or mound of water above the quiescent water level 34. The pneumatic valve assemblies are then switched in a desired sequence to the closed position illustrated in FIGS. 4 and 5A–C by operation of piston-and-cylinder units 104, 106. Movement of the sleeve 76 in the valve assemblies operatively closes the butterfly valve 118 in the sleeve, blocking the flow of air into the caisson. With the air pressure source removed, the water displaced from the caisson submerged portions 64 will naturally be replaced by water rushing through the submerged passage 42. The air thus displaced from the caisson upper air portion 66 will vent to the interior of the equipment housing 54.

It will be appreciated that the function of the dispersion plate 60 is to efficiently and evenly spread air from the valve assembly over the surface of the water within the submerged portion 64 of the caisson. The efficient dispersion of air over the water surface means less air is required and the volume of air required from the motor-fan assembly is reduced. In addition, the volume of air space required in the upper portion 66 of the caisson is reduced, allowing for a reduction in caisson height and a realization of the advantages attendant thereto as discussed above.

While the configuration of the dispersion grate 60 above is preferred, other grate configurations may be substituted without departing from the invention. By way of example, without any limitation intended, the grate within each caisson may be multi-piece rather than of unitary construction. Additionally, the configuration of the ribs and passageways through the grate may be altered if desired. While a four caisson system is shown in the preferred embodiment, a greater or lesser number of caissons may be employed, for example, in wider or narrower swimming pools.

The air valve assemblies 68–74 are actuated by an electrical control system (not shown). The electrical control system includes timer circuits for operating the wave generator 10 and controls the caisson charging and firing sequence and timing. The control system can sequence the firing of the pneumatic valve assemblies 68–74 to create alternative wave patterns. Since each caisson has its own, dedicated, valve assembly, the subject wave generator affords great flexibility in altering the shape and magnitude of generated waves.

It is to be understood that while certain forms of the present invention have been illustrated and described herein, the invention is not intended to be so limited. Other embodiments and configurations, which will be apparent to those skilled in the art, and which utilize the teachings herein set forth, are intended to be within the scope and spirit of the present invention.

What is claimed is:

1. A pneumatic wave generator, comprising:

at least one caisson with caisson sidewalls having an upper portion, a lower portion, and an open passage at the lower portion;

a sleeve assembly for directing a stream of air from a feed conduit into the upper portion of the caisson;

a dispersion plate mounted within the upper portion of the caisson for distributing the stream of air over the entire upper portion of the caisson and said dispersion plate nearly covers the entire upper portion of the caisson from caisson sidewall to caisson sidewall.

2. A wave generator as in claim 1, wherein the dispersion plate comprises a plurality of through-passageways extending from an upper side to a lower side of the dispersion plate.

3. A wave generator as in claim 1, wherein the dispersion plate comprises: a plurality of through-passageways at least partially defined by sidewalls extending from an upper side to a lower side of the dispersion plate.

4. A wave generator as in claim 3, wherein the sidewalls defining the through-passageways are disposed to intercept air distributed across an: upper side of the plate and direct the air downward through the passageways.

5. A wave generator as in claim 4, wherein the sidewalls comprise convergent upper and lower sidewall portions.

6. A wave generator as in claim 1, wherein the sleeve assembly comprises:

a sleeve having a centrally disposed, downwardly opening air passageway defined by internal sidewalls and extending between an upper passageway end and a lower passageway end in communication with the upper end of the caisson; and a shut-off valve mounted within the sleeve passageway above the lower passageway end for selectively opening and closing the air passageway.

7. A wave generator as in claim 6, wherein the shut-off valve is disposed between the lower end and the upper end of the sleeve air passageway.

8. A wave generator as in claim 7, wherein the shut-off valve comprises a butterfly valve pivotally mounted within the sleeve passageway and pivoting between an open position in which the movement of air through the sleeve passageway is relatively unobstructed and a closed position in which movement of air through the sleeve passageway is blocked.

9. A wave generator as in claim 8, wherein the butterfly valve is substantially elliptical and extends between the internal sleeve sidewalls in the closed position.

10. A wave generator as in claim 9, wherein the butterfly valve body is angled with respect to the internal sleeve sidewalls in the closed position.

11. A pneumatic wave generator, comprising:

at least one caisson having an upper portion, a lower portion and an open passage at the lower portion;

a sleeve assembly for directing a stream of air from a feed conduit into the upper portion of the caisson;

a dispersion grate mounted within and at least partially covering the upper portion of the caisson, the dispersion grate intercepting air from the directional sleeve assembly and distributing the air over the upper portion of the caisson; and, a butterfly valve pivotally mounted within the sleeve assembly and said butterfly valve can pivots between an open position in which the movement of air through the passageway is relatively unobstructed and a closed position in which movement of air through the sleeve passageway is blocked.

12. A pneumatic wave generator as in claim 11, wherein the dispersion grate comprises an upper side and a lower side and a plurality of spaced apart through passageways extending from the upper grate side to the lower grate side.

13. A pneumatic wave generator as in claim 12, wherein the dispersion grate further comprises plurality of directional vane flanges for distributing the stream of air from the directional sleeve to the through-passageways.

14. A pneumatic wave generator as in claim 12, wherein the dispersion grate through-passageways are at least partially defined by sidewalls extending from the upper side to the lower side of the dispersion plate.

15. A wave generator as in claim 14, wherein the sidewalls defining the through- passageways are positioned to intercept air distributed across an upper side of the plate and direct the air downward through the passageways.

16. A wave generator as in claim 15, wherein the sidewalls comprise convergent upper and lower sidewall portions.

17. A wave generator as in claim 11, wherein the butterfly valve is substantially elliptical and extends between the internal sleeve sidewalls in the closed position.

18. A wave generator as in claim 17, wherein the butterfly valve body is angled with respect to the internal sleeve sidewall in the closed position.

* * * * *